US011331769B2

(12) United States Patent
Kamimura et al.

(10) Patent No.: US 11,331,769 B2
(45) Date of Patent: May 17, 2022

(54) POLISHING APPARATUS AND POLISHING METHOD

(71) Applicant: EBARA CORPORATION, Tokyo (JP)

(72) Inventors: Kenji Kamimura, Tokyo (JP); Kenichi Kobayashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 71 days.

(21) Appl. No.: 15/431,062

(22) Filed: Feb. 13, 2017

(65) Prior Publication Data

US 2017/0239784 A1 Aug. 24, 2017

(30) Foreign Application Priority Data

Feb. 19, 2016 (JP) ..... JP2016-029817
Dec. 22, 2016 (JP) ..... JP2016-249782

(51) Int. Cl.
*B24B 51/00* (2006.01)
*B24B 41/06* (2012.01)
*B24B 47/00* (2006.01)

(52) U.S. Cl.
CPC ..... *B24B 51/00* (2013.01); *B24B 41/06* (2013.01); *B24B 47/00* (2013.01)

(58) Field of Classification Search
CPC ..... B24B 49/006; B24B 49/16; B24B 49/04; B24B 49/02; B24B 49/12; B24B 49/08; B24B 21/06; B24B 21/08; B24B 21/004; B24B 37/04; B24B 21/002; B24B 7/228
USPC ..... 700/164
See application file for complete search history.

(56) References Cited

U.S. PATENT DOCUMENTS 4,788,482 A * 11/1988 Tachibana ..... B25J 9/1633 318/611
5,796,927 A * 8/1998 Hegg ..... B25J 9/1633 318/568.18
6,431,953 B1 8/2002 Carter et al.
2002/0037681 A1* 3/2002 Gitis ..... B24B 37/013 451/5
2005/0260922 A1* 11/2005 Gan ..... B24B 37/013 451/5
2006/0019417 A1 1/2006 Shigeta et al.
2008/0287043 A1* 11/2008 Saito ..... B24B 49/14 451/285

(Continued)

FOREIGN PATENT DOCUMENTS

CN 1314096 C 5/2007
JP H03-142159 A 6/1991

(Continued)

*Primary Examiner* — Joel D Crandall
(74) *Attorney, Agent, or Firm* — BakerHostetler

(57) ABSTRACT

A polishing apparatus and a polishing method capable of detecting whether a polishing tool has been brought into contact with a substrate, such as a wafer, and further capable of detecting a position of the polishing tool are disclosed. The polishing apparatus includes a substrate holder configured to hold a substrate, a pressing member configured to press a polishing tool against a surface of the substrate, an actuator configured to apply a pressing force to the pressing member, a motor-drive moving device configured to move the pressing member along the surface of the substrate, and a monitoring device configured to emit an alarm if a motor current supplied to the motor-drive moving device is smaller than a threshold value.

16 Claims, 15 Drawing Sheets

(56) References Cited

U.S. PATENT DOCUMENTS

| | | | | |
|---|---|---|---|---|
| 2009/0117828 | A1 | 5/2009 | Hongo et al. | |
| 2009/0227189 | A1* | 9/2009 | Maeda | B24B 21/06 451/303 |
| 2009/0233525 | A1* | 9/2009 | Ueda | G01N 21/55 451/5 |
| 2011/0136411 | A1* | 6/2011 | Nakanishi | B24B 9/065 451/41 |
| 2014/0087627 | A1* | 3/2014 | Togawa | B24B 9/065 451/1 |
| 2014/0134924 | A1* | 5/2014 | Shinozaki | B24B 37/005 451/5 |
| 2014/0213154 | A1* | 7/2014 | Seki | B24B 9/065 451/44 |
| 2014/0220866 | A1* | 8/2014 | Ishii | B24B 21/004 451/41 |

FOREIGN PATENT DOCUMENTS

| | | | |
|---|---|---|---|
| JP | H05-018395 | U | 3/1993 |
| JP | H10-015458 | A | 1/1998 |
| JP | H11-291156 | A | 10/1999 |
| JP | 2011-224680 | A | 11/2011 |
| JP | 2013-188839 | A | 9/2013 |
| JP | 2014-061580 | A | 4/2014 |
| JP | 2014-150131 | A | 8/2014 |
| JP | 2014-150178 | A | 8/2014 |
| TW | 200613092 | A | 5/2006 |
| TW | 201008704 | A | 3/2010 |
| TW | 201429626 | A | 8/2014 |

* cited by examiner

POLISHING APPARATUS AND POLISHING METHOD

CROSS REFERENCE TO RELATED APPLICATIONS

This document claims priorities to Japanese Patent Application No. 2016-029817 filed Feb. 19, 2016 and Japanese Patent Application No. 2016-249782 filed Dec. 22, 2016, the entire contents of which are hereby incorporated by reference.

BACKGROUND

In recent years, devices, such as memory circuits, logic circuits, image sensors (e.g., CMOS sensors), or the like have been more and more highly integrated. During processes of producing these devices, foreign matter such as minute particles, dust, etc. may be deposited on the devices. Foreign matter deposited on the devices is likely to cause circuit defect and short circuit between interconnects. In order to increase device reliability, it is therefore necessary to clean wafers on which devices are formed to remove foreign matter from the wafers. Foreign matter such as minute particles, dust, etc., referred to above, may also be deposited on back surfaces of wafers. If the foreign matter is deposited on the back surface of the wafer, the wafer may be separated from a stage reference surface of an exposure machine, or the wafer surface may be tilted with respect to the stage reference surface, resulting in a patterning error or a focal length error.

There has recently been proposed a polishing apparatus which is capable of removing foreign matter deposited on a back surface of a wafer at a high removal rate (see Japanese laid-open patent publication No. 2014-150178). This new polishing apparatus is able to scrape off the back surface of the wafer to a small extent by moving a polishing tool along the back surface of the wafer while pressing the polishing tool against the back surface of the wafer with an air cylinder. As a consequence, the polishing apparatus can remove the foreign matter from the back surface of the wafer at a high removal rate.

The above-described polishing apparatus is configured to press the polishing tool against the wafer by supplying the air cylinder with compressed air having a certain preset pressure. However, since there exists a sliding resistance of a piston in the air cylinder, the polishing tool may actually be out of contact with the wafer even when the air cylinder is supplied with the compressed air having the preset pressure. In the event of such a contact failure, the wafer is not properly polished, leaving foreign matter unremoved on the wafer.

SUMMARY OF THE INVENTION

According to an embodiment, there are provided a polishing apparatus and a polishing method capable of detecting whether a polishing tool has been brought into contact with a substrate, such as a wafer, and further capable of detecting a position of the polishing tool.

Embodiments, which will be described below, relate to an apparatus and a method for polishing a substrate, such as a wafer, and more particularly to an apparatus and a method for polishing a substrate by moving a polishing tool, such as a polishing tape, while pressing the polishing tool against a surface of the substrate.

In one embodiment, there is provided a polishing apparatus comprising: a substrate holder configured to hold a substrate; a pressing member configured to press a polishing tool against a surface of the substrate; an actuator configured to apply a pressing force to the pressing member; a motor-drive moving device configured to move the pressing member along the surface of the substrate; and a monitoring device configured to emit an alarm if a motor current supplied to the motor-drive moving device is smaller than a threshold value.

In one embodiment, the monitoring device is configured to calculate an average of the motor current measured within a predetermined period of time and to emit the alarm if the average of the motor current is smaller than the threshold value.

In one embodiment, the predetermined period of time is a period of time including at least a part of a period of time during which the motor-drive moving device is moving the pressing member along the surface of the wafer.

In one embodiment, the polishing apparatus further includes a load measuring device disposed between the pressing member and the actuator, wherein the monitoring device is configured to emit the alarm if a load measured by the load measuring device is smaller than a set value.

In one embodiment, there is provided a polishing apparatus comprising: a substrate holder configured to hold a substrate; a pressing member configured to press a polishing tool against a surface of the substrate; an actuator configured to apply a pressing force to the pressing member; a motor-drive moving device configured to move the pressing member along the surface of the substrate; a distance measuring device configured to measure a movement distance of the pressing member that has been moved toward the surface of the substrate by the actuator; and a monitoring device configured to emit an alarm if the movement distance is smaller than a threshold value.

In one embodiment, the monitoring device is configured to emit the alarm and instruct the actuator to move the pressing member back to a retreated position and then to move the pressing member toward the surface of the substrate again, if the movement distance is smaller than the threshold value.

In one embodiment, the monitoring device is configured to instruct the motor-drive moving device to move the pressing member along the surface of the substrate, if the movement distance is larger than the threshold value.

In one embodiment, the polishing apparatus further comprises a load measuring device disposed between the pressing member and the actuator, wherein the monitoring device is configured to emit the alarm if a load measured by the load measuring device is smaller than a set value.

In one embodiment, the distance measuring device comprises a non-contact-type distance sensor.

In one embodiment, the distance measuring device comprises one of a digital gage, a magnetic sensor, and an eddy current sensor.

In one embodiment, there is provided a polishing method comprising: holding a substrate with a substrate holder; pressing a polishing tool against a surface of the substrate with a pressing member; moving the pressing member along the surface of the substrate with a motor-drive moving device; and emitting an alarm if a motor current supplied to the motor-drive moving device is smaller than a threshold value.

In one embodiment, said emitting the alarm comprises calculating an average of the motor current measured within a predetermined period of time, and emitting the alarm if the average of the motor current is smaller than the threshold value.

In one embodiment, the predetermined period of time is a period of time including at least a part of a period of time during which the motor-drive moving device is moving the pressing member along the surface of the wafer.

In one embodiment, the polishing method further comprises: measuring a load applied to the pressing member; and emitting an alarm if the load is smaller than a set value.

In one embodiment, the surface of the substrate comprises a back surface of the wafer.

In one embodiment, there is provided a polishing method comprising: holding a substrate with a substrate holder; moving a pressing member, which supports a polishing tool, toward a surface of the substrate with an actuator; measuring a movement distance of the pressing member that has been moved by the actuator; and emitting an alarm if the movement distance is smaller than a threshold value.

In one embodiment, said emitting the alarm comprising emitting an alarm, and moving the pressing member back to a retreated position with the actuator and then moving the pressing member toward the surface of the substrate again, if the movement distance is smaller than the threshold value.

In one embodiment, the polishing method further comprises moving the pressing member along the surface of the substrate with a motor-drive moving device if the movement distance is larger than the threshold value.

In one embodiment, the polishing method further comprises: measuring a load applied from the actuator to the pressing member; and emitting an alarm if the load is smaller than a set value.

In one embodiment, the surface of the substrate comprises a back surface of the wafer.

When the polishing tool is properly placed in contact with the surface (e.g., a front surface, a back surface, or a bevel portion) of a substrate, such as a wafer, a frictional force is generated between the polishing tool and the substrate as the polishing tool moves along the surface of the substrate. Because the motor-drive moving device is configured to move the pressing member at a preset speed, the magnitude of the motor current can vary depending on the frictional force. Therefore, the monitoring device is able to determine whether the polishing tool has been properly brought into contact with the substrate on the basis of the result of the comparison between the motor current and a threshold value.

If the movement distance of the pressing member that has been moved toward the surface of the substrate is short, the polishing tool is unable to contact the substrate. Therefore, the monitoring device is able to determine whether the polishing tool has properly contacted the substrate on the basis of the result of the comparison between the movement distance (or displacement) of the pressing member and a threshold value.

DESCRIPTION OF EMBODIMENTS

Embodiments will be described below with reference to the drawings.

Figure 1A:
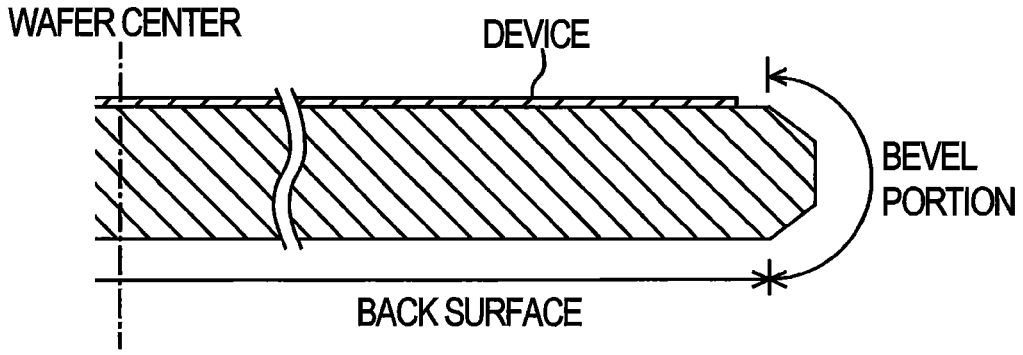
FIG. 1A and FIG. 1B are cross-sectional views each showing a wafer which is an example of a substrate.
Figure 1B:
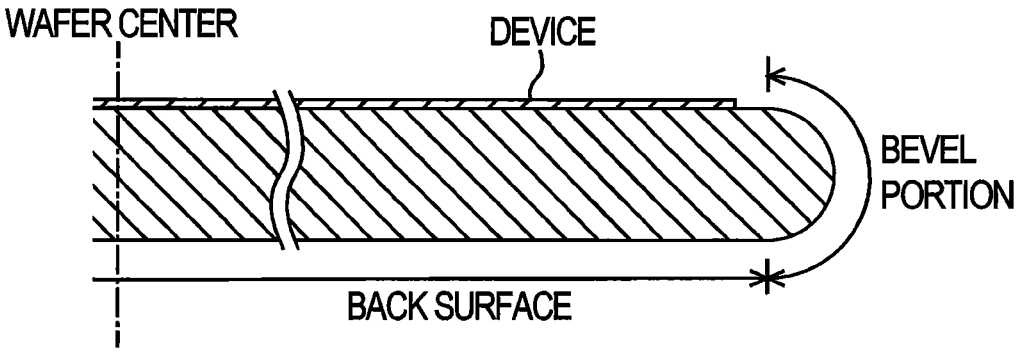

FIG. 1A and FIG. 1B are cross-sectional views each showing a wafer which is an example of a substrate. More specifically, FIG. 1A is a cross-sectional view of a so-called straight-type wafer, and FIG. 1B is a cross-sectional view of a so-called round-type wafer. In this specification, a back surface of a wafer (or a substrate) refers to a flat surface which is an opposite side of the wafer from a surface on which devices are formed. The outermost peripheral surface of the wafer is referred to as a bevel portion. The back surface of the wafer is the flat surface that is located radially inwardly of the bevel portion. The back surface of the wafer is adjacent to the bevel portion.

Embodiments, which will be described below, are directed to a polishing apparatus and a polishing method for polishing a back surface of a wafer that is an example of a substrate, while it is noted that the present invention is also applicable to a polishing apparatus and a polishing method for polishing a front surface or a bevel portion of a wafer.

Figure 2:
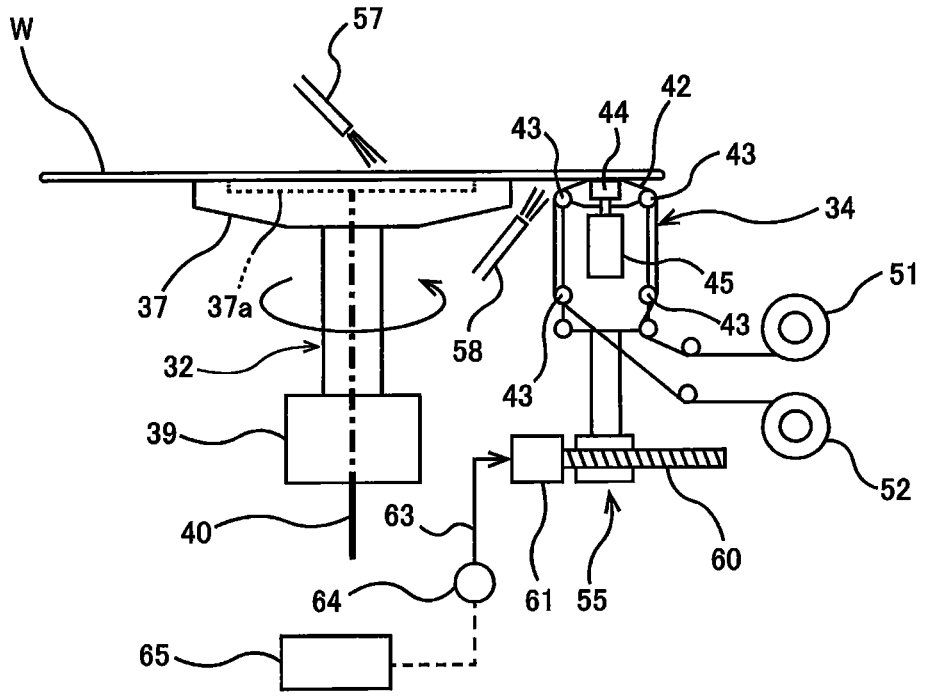
FIG. 2 is a schematic view showing a polishing apparatus for polishing a back surface of a wafer.

FIG. 2 is a schematic view showing a polishing apparatus for polishing a back surface of a wafer. The polishing apparatus includes a substrate holder 32 for holding and rotating a wafer (substrate) W, and a polishing head 34 for pressing a polishing tool against a back surface of the wafer W that is held by the substrate holder 32. The substrate holder 32 includes a substrate stage 37 for holding the wafer W thereon via vacuum suction, and a stage motor 39 for rotating the substrate stage 37.

The wafer W, with its back surface facing downwardly, is placed on the substrate stage 37. The substrate stage 37 has a groove 37*a* formed in its upper surface, and this groove 37*a* is in fluid communication with a vacuum line 40. The vacuum line 40 is coupled to a vacuum source (e.g., a vacuum pump), which is not shown in the drawings. When a vacuum is developed in the groove 37*a* of the vacuum stage 37 through the vacuum line 40, the wafer W is held on the substrate stage 37 by the vacuum suction. Then, the stage motor 39 rotates the substrate stage 37, thereby rotating the wafer W about its own axis. A diameter of the substrate stage 37 is smaller than a diameter of the wafer W, and a center-side area of the back surface of the wafer W is held by the substrate stage 37. The back surface of the wafer W has a circumferential-side area which is projecting outwardly from the substrate stage 37.

The polishing head 34 is disposed adjacent to the substrate stage 37. More specifically, the polishing head 34 is disposed so as to face the exposed circumferential-side area of the wafer W. The polishing head 34 includes a plurality of rollers 43 supporting a polishing tape 42 that serves as a polishing tool, a pressing member (e.g., a pressing pad) 44 for pressing the polishing tape 42 against the back surface of the wafer W, and an air cylinder 45 serving as an actuator for applying a pressing force to the pressing member 44. The air cylinder 45 exerts the pressing force on the pressing member 44, which in turn presses the polishing tape 42 against the back surface of the wafer W. The polishing tool may be a fixed abrasive, instead of the polishing tape.

Figure 3:
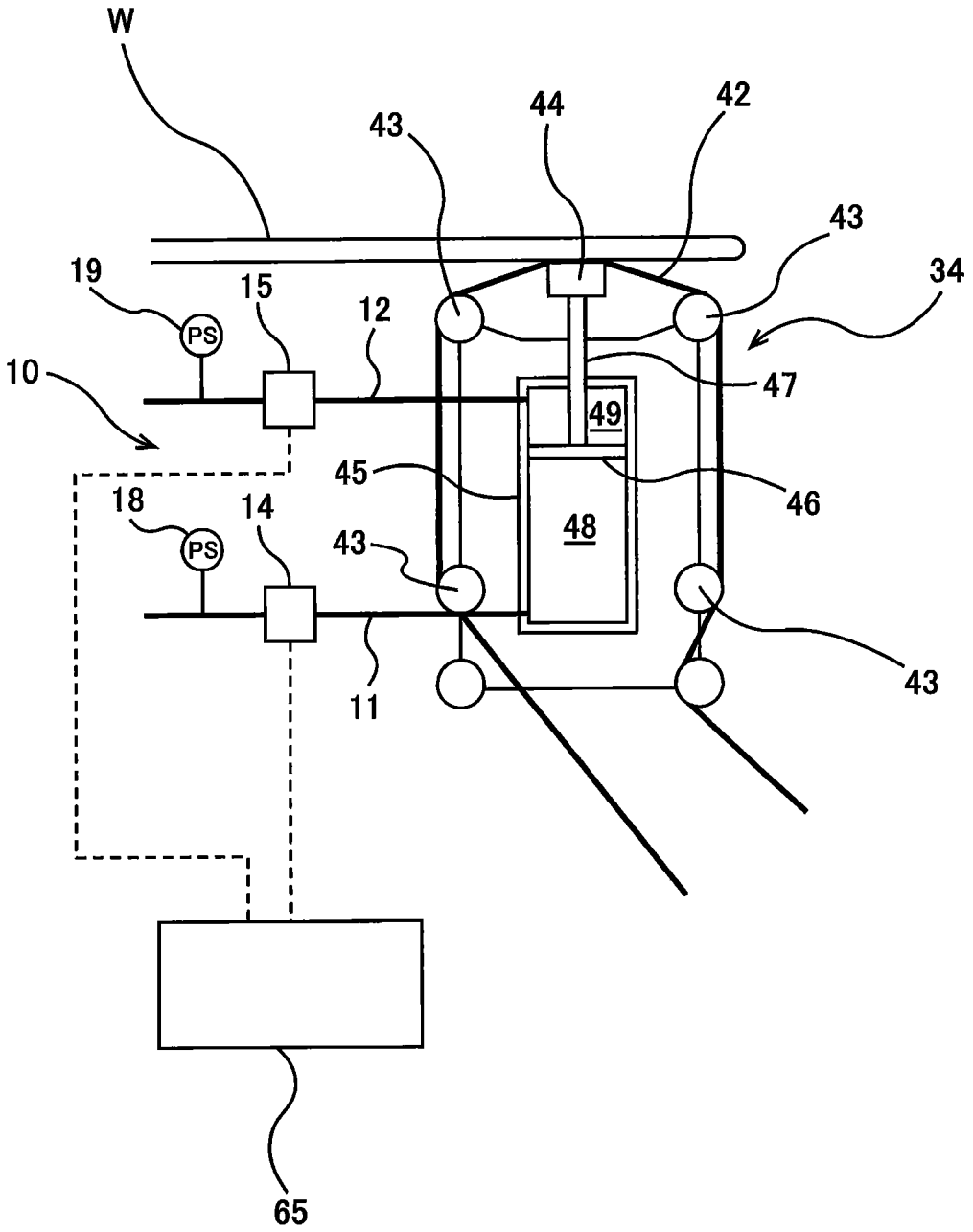
FIG. 3 is a schematic view showing a gas supply system for supplying a pressurized gas into an air cylinder shown in FIG. 2.

FIG. 3 is a schematic view showing a gas supply system 10 for supplying a pressurized gas (e.g., a pressurized air) into the air cylinder 45 shown in FIG. 2. The gas supply system 10 includes a load-pressure line 11 which is in fluid communication with a first chamber 48 of the air cylinder 45, a back-pressure line 12 which is in fluid communication with a second chamber 49 of the air cylinder 45, a first pressure regulator 14 attached to the load-pressure line 11, and a second pressure regulator 15 attached to the back-pressure line 12. The first chamber 48 and the second chamber 49 are isolated from each other by a piston 46 disposed in the air cylinder 45. The piston 46 is fixed to a piston rod 47, and the pressing member 44 is attached to the piston rod 47. The piston 46, the piston rod 47, and the pressing member 44 are movable together with each other.

The load-pressure line 11 and the back-pressure line 12 are coupled to a pressurized-gas supply source (e.g., a pressurized-air supply source), which is not shown in the drawings. A first pressure sensor 18 and a second pressure sensor 19 are coupled to the load-pressure line 11 and the back-pressure line 12, respectively. The pressures of the gas in the load-pressure line 11 and the back-pressure line 12 at upstream sides of the first pressure regulator 14 and the second pressure regulator 15 are measured by the first pressure sensor 18 and the second pressure sensor 19, respectively. The pressurized gas is supplied through the load-pressure line 11 and the first pressure regulator 14 into the first chamber 48 of the air cylinder 45. Similarly, the pressurized gas is supplied through the back-pressure line 12 and the second pressure regulator 15 into the second chamber 49 of the air cylinder 45.

When the pressurized gas is supplied into the first chamber 48 of the air cylinder 45, the pressurized gas in the first chamber 48 presses the piston 46, thereby moving the piston rod 47 and the pressing member 44 toward the wafer W. When the pressurized gas is supplied into the second chamber 49 of the air cylinder 45, the pressurized gas in the second chamber 49 presses the piston 46 in the opposite direction, thereby moving the piston rod 47 and the pressing member 44 in a direction away from the wafer W.

The first pressure regulator 14 and the second pressure regulator 15 are coupled to a monitoring device 65, which is configured to control operations of the first pressure regulator 14 and the second pressure regulator 15. The force with which the pressing member 44 presses the polishing tape 42 against the back surface of the wafer W is regulated by the first pressure regulator 14. Specifically, when the pressure of the pressurized gas supplied to the first chamber 48 of the air cylinder 45 is increased, the pressing force of the pressing member 44 increases. The monitoring device 65 sends target pressure command values to the first pressure regulator 14 and the second pressure regulator 15, respectively, and the first pressure regulator 14 and the second pressure regulator 15 operate so as to keep the pressures in the first chamber 18 and the second chambers 19 at the respective target pressure command values.

Referring back to FIG. 2, the polishing tape 42 has an end coupled to a feeding reel 51, and has the other end coupled to a take-up reel 52. The polishing tape 42 is advanced at a predetermined speed from the feeding reel 51 via the polishing head 34 to the take-up reel 52. The polishing tape 42 that can be used may be, for example, a tape with abrasive grains fixed to a surface thereof, or may be a tape made of hard nonwoven fabric. The polishing head 34 is coupled to a polishing-head moving device 55. This polishing-head moving device 55 is configured to move the polishing head 34 and the polishing tape 42 outwardly in the radial direction of the wafer W.

The polishing-head moving device 55 is a motor-drive moving device including a combination of a ball screw 60 and a servomotor 61. The polishing-head moving device 55 is configured to move the polishing tape 42 and the polishing head 34 at a preset speed along the back surface of the wafer W. The servomotor 61 is coupled to an electric power line 63 and is supplied with an electric current through the electric power line 63. The electric current supplied to the servomotor 61 will hereinafter be referred to as "motor current". An ammeter 64 for measuring the motor current is coupled to the electric power line 63. The ammeter 64 is coupled to the monitoring device 65, which monitors the motor current supplied to the servomotor 61.

Liquid supply nozzles 57, 58 for supplying a polishing liquid onto the wafer W are disposed respectively above and below the wafer W that is held on the substrate stage 37. The polishing liquid may preferably be pure water. This is because if a liquid chemical containing a chemical component having an etching capability is used as the polishing liquid, recesses formed in the back surface of the wafer W would be enlarged.

The back surface of the wafer W is polished as follows. The wafer W, held on the substrate stage 37, is rotated about the axis of the wafer W by the stage motor 39, and the liquid supply nozzles 57, 58 supply the polishing liquid to the front and back surfaces of the wafer W which is being rotated. The polishing head 34 then presses the polishing tape 42 against the back surface of the wafer W. The polishing tape 42 is placed in sliding contact with the back surface of the wafer W, thus polishing the back surface of the wafer W.

Figure 4:
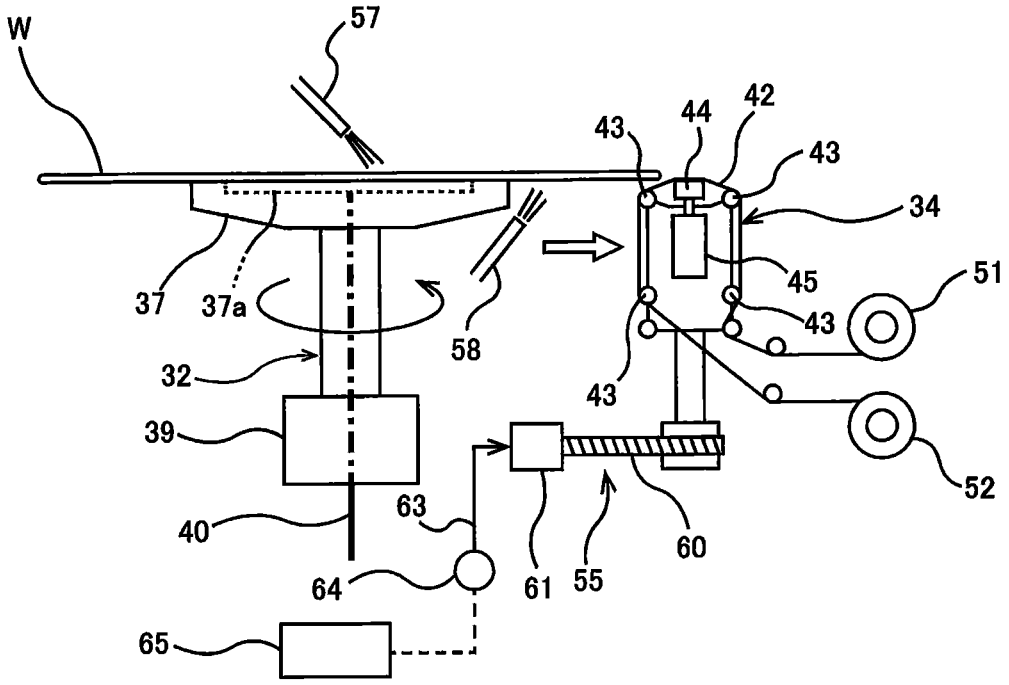
FIG. 4 is a view showing a manner in which a polishing head and a polishing tape are moved outwardly in a radial direction of the wafer along the back surface of the wafer at a preset speed.

While the polishing head 34 is pressing the polishing tape 42 against the back surface of the wafer W, the polishing-head moving device 55 moves the polishing head 34 and the polishing tape 42 at a preset speed along the back surface of the wafer W outwardly in the radial direction of the wafer W, as indicated by arrow shown in FIG. 4. In this manner, the circumferential-side area of the back surface of the wafer W is polished by the polishing tape 42. During the polishing process, the polishing liquid flows from the inside to the outside of the wafer W, and polished-off debris is removed from the wafer W by the polishing liquid.

Figure 5:
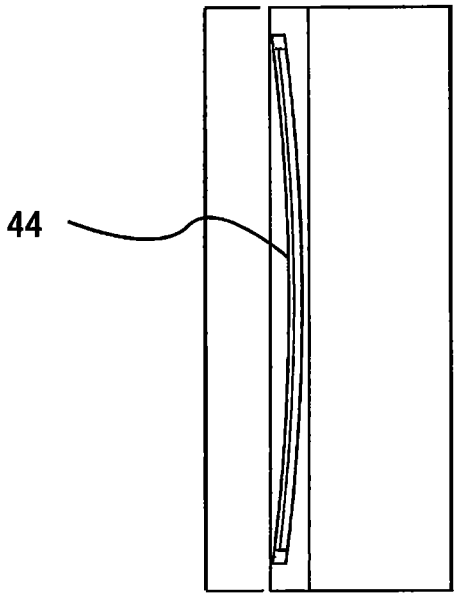
FIG. 5 is a plan view of an embodiment of a pressing member.
Figure 6:
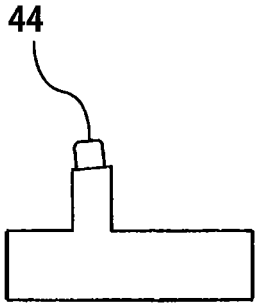
FIG. 6 is a side elevational view of the pressing member.

FIG. 5 is a plan view showing an embodiment of the pressing member 44, and FIG. 6 is a side elevational view of the pressing member 44. The pressing member 44 includes a protrusion having an arcuate shape which has the same curvature as the curvature of the wafer W. The pressing member 44 having such a shape is able to provide a uniform contact time during which the polishing tape 42 and the wafer W are placed in contact with each other and to provide a uniform contact pressure under which the polishing tape 42 and the wafer W are placed in contact with each other, over the entire area to be polished.

When the polishing tape 42 is properly placed in contact with the wafer W, a frictional force is generated between the polishing tape 42 and the wafer W when the polishing tape 42 moves along the surface of the wafer W. Since the motor-drive polishing-head moving device 55 moves the polishing head 34 that supports the polishing tape 42 at a preset speed, the magnitude of the motor current can vary in accordance with the frictional force. In other words, when the polishing tape 42 is properly placed in contact with the wafer W, a large frictional force is generated, resulting in an increased motor current. In contrast, when the polishing tape 42 is not in contact with the wafer W, the motor current is small because no frictional force is generated. The monitoring device 65 is configured to compare the motor current with a threshold value and to determine whether the polishing tape 42 is properly placed in contact with the wafer W, based on the result of the comparison.

Figure 7:
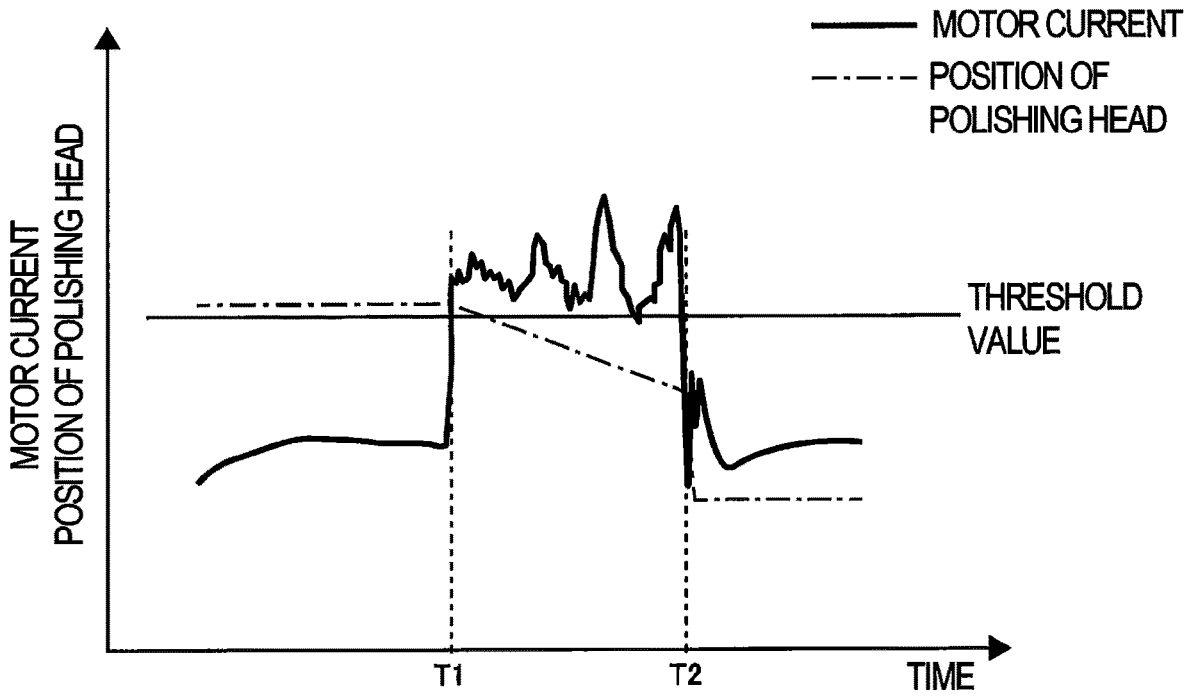
FIG. 7 is a graph showing how a motor current varies.

FIG. 7 is a graph showing how the motor current varies. In FIG. 7, a vertical axis represents motor current and position of the polishing head 34, and a horizontal axis represents time. In the example shown in FIG. 7, a position of the polishing head 34 at a time T1 is a polishing start position, and a position of the polishing head 34 at a time T2 is a polishing end position. The polishing start position and the polishing end position are preset. The polishing tape 42 is brought into contact with the wafer W at the time T1, and is separated from the wafer W at the time T2. With the polishing tape 42 in contact with the back surface of the wafer W, the polishing-head moving device 55 moves the polishing tape 42 and the polishing head 34 at a preset speed along the back surface of the wafer W. During this operation, the motor current becomes large due to the frictional force generated between the polishing tape 42 and the wafer W.

The monitoring device 65 monitors the motor current based on measured values thereof that are sent from the ammeter 64, and compares the measured values of the motor current with the threshold value. The threshold value is stored in advance in the monitoring device 65. The fact that the motor current is lower than the threshold value when the polishing-head moving device 55 is moving the polishing tape 42 and the polishing head 34 means that the polishing tape 42 is separated from the wafer W or is not properly placed in contact with the wafer W. The monitoring device 65 is thus configured to emit an alarm if the motor current is smaller than the threshold value. The alarm may be an electric signal (e.g., an ON or OFF contact signal) for activating an external alarm device, an electric signal (e.g., an analog output such as a voltage) for transmitting information to an external device, or a recognizable signal such as a color, a sound, or the like.

As shown in FIG. 7, when the polishing tape 42 and the pressing member 44 are moving along the back surface of the wafer W, the motor current fluctuates to a certain extent. The motor current may fluctuate due to various factors including the pressing force applied to the polishing tape 42, a condition of the back surface of the wafer W, a condition of a polishing surface of the polishing tape 42, a speed at which the polishing tape 42 is advanced, etc. If the motor current fluctuates greatly while the wafer W is being polished, the monitoring device 65 is unable to determine correctly whether the polishing tape 42 is placed in contact with the back surface of the wafer Wt.

Thus, in order to more accurately determine whether the polishing tape 42 is in contact with the back surface of the wafer W, in one embodiment, the monitoring device 65 is configured to calculate an average of the motor current measured within a predetermined period of time, and to emit an alarm if the calculated average of the motor current is smaller than a threshold value. The predetermined period of time referred to above is, for example, a period of time including at least a part of the period of time during which the polishing-head moving device 55 is moving the pressing member 44 together with the polishing tape 42 along the back surface of the wafer W from the polishing start position to the polishing end position. The predetermined period of time may be an entirety or a part of the period of time during which the polishing-head moving device 55 is moving the pressing member 44 together with the polishing tape 42 along the back surface of the wafer W from the polishing start position to the polishing end position. In this manner, the monitoring device 65 determines whether the polishing tape 42 is properly in contact with the back surface of the wafer W, on the basis of the magnitude of the motor current that is measured when the pressing member 44 is moving along the back surface of the wafer W.

Figure 8:
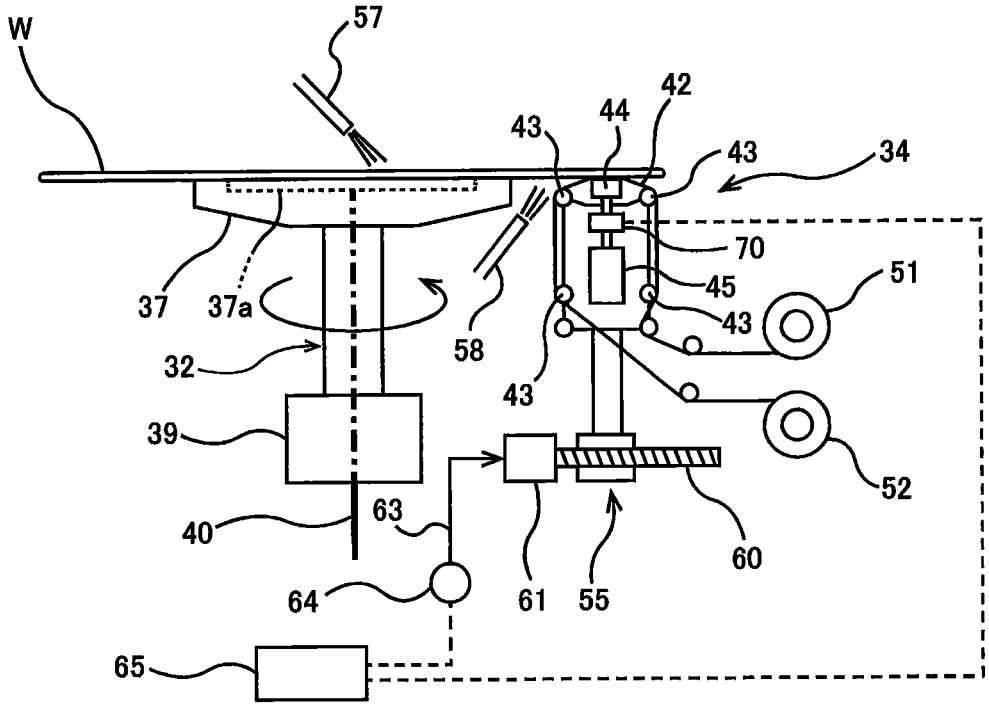
FIG. 8 is a view showing a polishing apparatus according to another embodiment.

FIG. 8 is a view showing a polishing apparatus according to another embodiment. Structural and operational details that are not described in particular are identical to those of the embodiment shown in FIGS. 2 through 6, and their repetitive descriptions will be omitted below. According to the present embodiment, the polishing head 34 includes a load cell 70 serving as a load measuring device disposed between the polishing tape 42 and the air cylinder (or actuator) 45. More specifically, the load cell 70 is disposed between the pressing member 44 that supports the polishing tape 42 and the air cylinder 45. A load produced by the air cylinder 45 is transmitted via the load cell 70 to the pressing member 44. The load cell 70 is coupled to the monitoring device 65, and sends a measured value of the load to the monitoring device 65.

When the polishing tape 42 is in contact with the back surface of the wafer W, the load is transmitted from the air cylinder 45 to the pressing member 44. On the other hand, when the polishing tape 42 is not placed in contact with the back surface of the wafer W, almost no load is transmitted from the air cylinder 45 to the pressing member 44. In other words, when the polishing tape 42 is in contact with the back surface of the wafer W, the load measured by the load cell 70 is large, and when the polishing tape 42 is not in contact with the back surface of the wafer W, the load measured by the load cell 70 is small.

The monitoring device 65 is configured to compare the load, which is applied to the pressing member 4 and measured by the load cell 70, with a set value, and to emit an alarm if the load is smaller than the set value. The set value is stored in advance in the monitoring device 65. The alarm may be an electric signal (e.g., an ON or OFF contact signal) for activating an external alarm device, an electric signal (e.g., an analog output such as a voltage) for transmitting information to an external device, or a recognizable signal such as a color, a sound, or the like. According to the present embodiment, the alarm based on the result of the comparison between the load and the set value is emitted, in addition to the alarm that is emitted based on the result of the comparison between the motor current and the threshold value.

Figure 9:
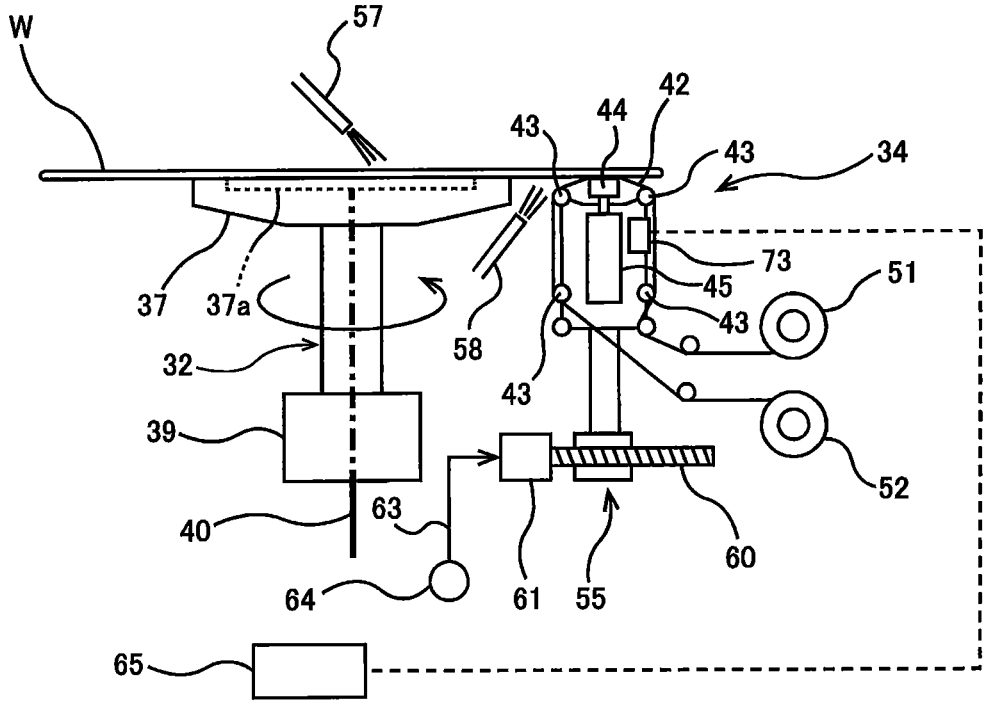
FIG. 9 is a view showing a polishing apparatus according to still another embodiment.

FIG. 9 is a view showing a polishing apparatus according to still another embodiment. Structural and operational details that are not described in particular are identical to those of the embodiments shown in FIGS. 2 through 6, and their repetitive descriptions will be omitted below. According to the present embodiment, the polishing apparatus includes a distance measuring device 73 for measuring a movement distance of the pressing member 44 which has been moved toward the back surface of the wafer W by the air cylinder 45. This distance measuring device 73 is fixed to the polishing head 34 and is coupled to the monitoring device 65. A measured value of the movement distance of the pressing member 44 is sent from the distance measuring device 73 to the monitoring device 65.

The monitoring device 65 is configured to monitor, instead of the motor current, the movement distance of the pressing member 44 that has been moved by the air cylinder 45 and to emit an alarm if the movement distance measured by the distance measuring device 73 is smaller than a threshold value. In one embodiment, the monitoring device 65 may be configured to compare both the motor current and the movement distance of the pressing member 44 with corresponding threshold values and to emit an alarm if one or both of the motor current and the movement distance of the pressing member 44 are smaller than the corresponding threshold values.

The monitoring device 65 is configured to determine whether the polishing tape 42 has contacted the back surface of the wafer W, on the basis of the movement distance measured by the distance measuring device 73, i.e., on the basis of the movement distance of the pressing member 44 that supports the polishing tape 42. More specifically, the monitoring device 65 is configured to emit an alarm if the movement distance, measured by the distance measuring device 73, is smaller than a threshold value. The threshold value is stored in advance in the monitoring device 65. The alarm may be an electric signal (e.g., an ON or OFF contact signal) for activating an external alarm device, an electric signal (e.g., an analog output such as a voltage) for transmitting information to an external device, or a recognizable signal such as a color, a sound, or the like. If the movement distance measured by the distance measuring device 73 is smaller than the threshold value, then the monitoring device 65 emits an alarm, and may instruct the air cylinder 45 to move the pressing member 44 back to a retreated position and then move the pressing member 44 again toward the back surface of the wafer W.

The threshold value is a value that has been obtained in advance by subtracting an offset value from the movement distance of the pressing member 44 that has been moved until the polishing tape 42 is actually brought into contact with the back surface of the wafer W. The offset value is determined on the basis of vibration factors of the polishing tape 42, such as a wafer surface vibration when the wafer is rotating, a vibration due to the friction between the polishing tape 42 and the wafer W, and the like. The offset value is set arbitrarily so long as the threshold value falls within an effective measuring range of the distance measuring device 73. Since the offset value is set in the monitoring device 65, the threshold value can easily be adjusted without changing the position of the distance measuring device 73 even after the pressing member 44 is replaced with a new one.

If the movement distance measured by the distance measuring device 73 is smaller than the threshold value, then the monitoring device 65 emits the alarm and the polishing apparatus may preferably not perform polishing of the wafer W. If the movement distance measured by the distance measuring device 73 is larger than the threshold value, then the monitoring device 65 may preferably instruct the polishing-head moving device 55 to move the pressing member 44 together with the polishing tape 42 along the back surface of the wafer W to thereby perform the polishing of the wafer W. If the movement distance measured by the distance measuring device 73 is larger than a preset upper limit value, then it is assumed that the wafer W is warped more than expected or the wafer W is detached from the substrate stage 37. Therefore, if the measured movement distance is larger than the upper limit value, then the monitoring device 65 emit an alarm and the polishing apparatus may preferably not perform polishing of the wafer W.

In order to more accurately determine whether the polishing tape 42 is in contact with the back surface of the wafer W, in one embodiment, the monitoring device 65 may be configured to calculate an average of the movement distance of the pressing member 44 measured by the distance measuring device 73 within a predetermined period of time, and to emit an alarm if the average of the movement distance is smaller than a threshold value. If the average of the movement distance measured by the distance measuring device 73 is smaller than the threshold value, then the monitoring device 65 may emit an alarm and may instruct the air cylinder 45 to move the pressing member 44 back to a retreated position and then move the pressing member 44 again toward the back surface of the wafer W. If the average of the movement distance is smaller than the threshold value, then the monitoring device 65 generates the alarm and the polishing apparatus may preferably not perform polishing of the wafer W. If the average of the movement distance is larger than the threshold value, the monitoring device 65 may preferably instruct the polishing-head moving device 55 to move the pressing member 44 together with the polishing tape 42 along the back surface of the wafer W to thereby perform the polishing of the wafer W. Furthermore, if the average of the movement distance measured by the distance measuring device 73 is larger than the preset upper limit value, then the monitoring device 65 emits an alarm and the polishing apparatus may preferably not perform polishing of the wafer W.

Figure 10:
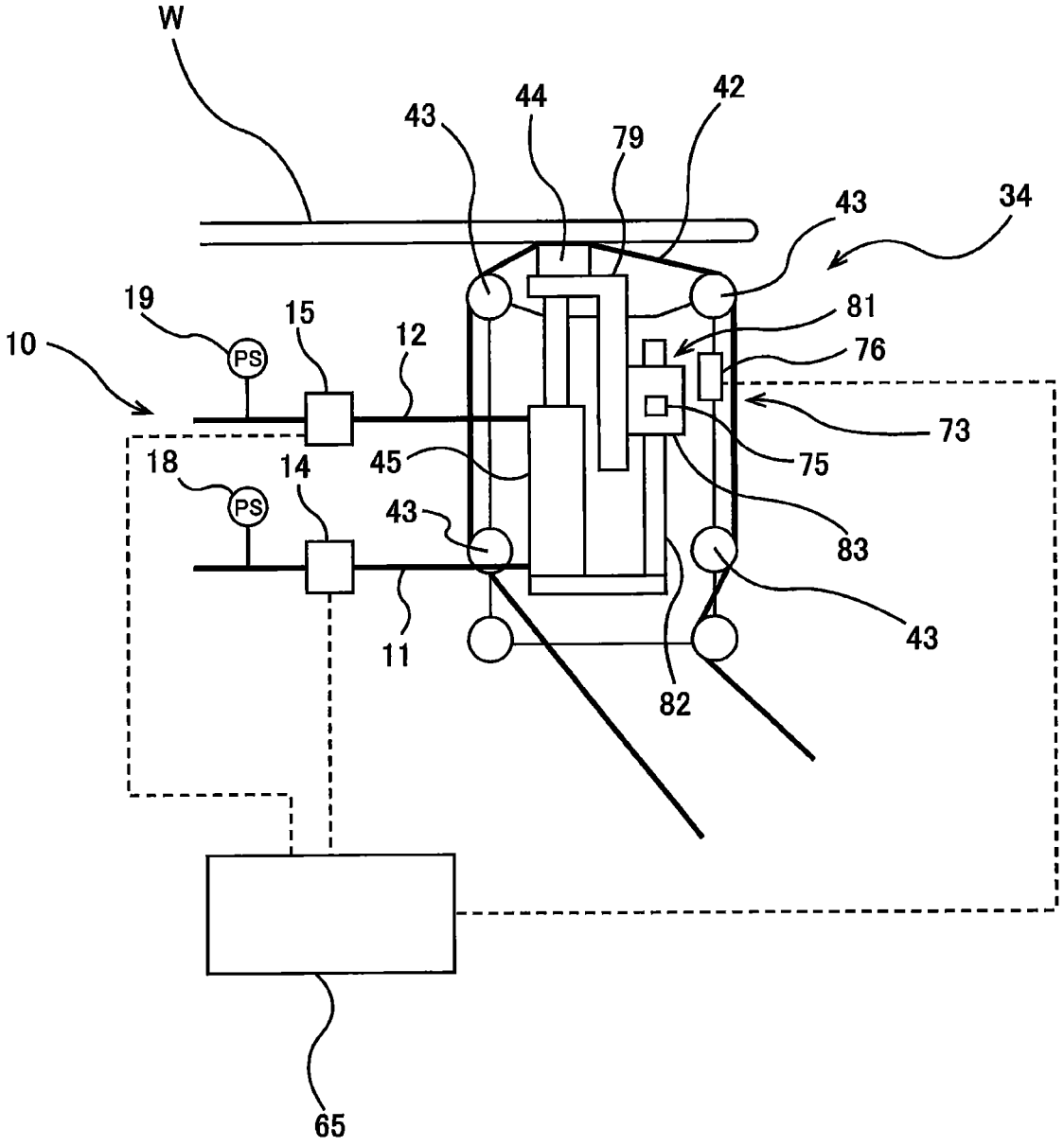
FIG. 10 is an enlarged view showing an embodiment of a polishing head shown in FIG. 9.

FIG. 10 is an enlarged view of the polishing head 34 according to an embodiment shown in FIG. 9. According to the present embodiment, the distance measuring device 73 includes a non-contact-type distance sensor. More specifically, the distance measuring device 73 includes a combination of a sensor target 75 and a proximity sensor 76. The sensor target 75 and the proximity sensor 76 are spaced from each other. In one example, the proximity sensor 76 may be an eddy current sensor or a magnetic sensor, and the sensor target 75 may be made of a magnet (or a permanent magnet) or a metal.

The polishing head 34 includes a linear-motion guide 81 coupled to the pressing member 44 through a coupling base 79. This linear-motion guide 81 has a linear-motion rail 82 extending perpendicularly to the back surface of the wafer W, and a linear-motion block 83 movable on the linear-motion rail 82 in its longitudinal direction. The sensor target 75 is fixed to the linear-motion block 83, so that the sensor target 75 is movable together with the linear-motion block 83 in the longitudinal directions of the linear-motion rail 82. The linear-motion block 83 is coupled to the pressing member 44 through the coupling base 79. Therefore, the movement of the pressing member 44 that is actuated by the air cylinder 45 is restricted to a linear movement.

The proximity sensor 76 is located near the sensor target 75. A relative position of the proximity sensor 76 and the polishing head 34 is fixed. A distance between the sensor target 75 and the proximity sensor 76 varies in accordance with the displacement of the pressing member 44, i.e., the movement distance (displacement) of the polishing tape 42 on the pressing member 44. Therefore, the distance measuring device 73, which includes the combination of the sensor target 75 and the proximity sensor 76, is able to measure the movement distance of the pressing member 44 that has been moved toward the wafer W by the air cylinder 45. The proximity sensor 76 is coupled to the monitoring device 65. The proximity sensor 76 is configured to measure the movement distance of the pressing member 44 that has been moved toward the wafer W and to send a measured value of the movement distance to the monitoring device 65.

If the movement distance of the pressing member 44, which is measured by the proximity sensor 76, is smaller than the above threshold value, then the monitoring device 65 may instruct the first pressure regulator 14 to increase the pressure in the first chamber 48 (see FIG. 3) of the air cylinder 45, thereby increasing the pressing force applied from the air cylinder 45 to the pressing member 44. More specifically, the monitoring device 65 may calculate a corrective pressing force from a preset target movement distance, the movement distance of the pressing member 44 which is measured by the proximity sensor 76, and a set value for the pressing force, and may instruct the air cylinder 45 to generate the corrective pressing force.

The monitoring device 65 stores, in advance, the following calculating formula therein:

Corrective pressing force=(target movement distance/measured movement distance)×set value for the pressing force In the above formula, the target movement distance is a theoretical movement distance of the pressing member 44 which allows the pressing member 44 to press the polishing tape 42 properly against the back surface of the wafer W. The measured movement distance is an actual movement distance of the pressing member 44 which is measured by the proximity sensor 76. The set value for the pressing force is a present set value for the pressing force that is applied from the air cylinder 45 to the pressing member 44.

The monitoring device 65 inputs the preset target movement distance, the movement distance of the pressing member 44 which is measured by the proximity sensor 76, and the set value for the pressing force into the above calculating formula to calculate a corrective pressing force, and instructs the air cylinder 45 to generate the corrective pressing force. More specifically, the monitoring device 65 determines a target pressure command value for the air cylinder 45 to generate the corrective pressing force, and sends the target pressure command value to the first pressure regulator 14. The monitoring device 65 stores, in advance, a relational expression or database representing the relationship between target pressure command value and pressing force, and is configured to determine a target pressure command value corresponding to the corrective pressing force using the relational expression or database. With the above operation of correcting the pressing force, the pressing member 44 is able to press the polishing tape 42 properly against the back surface of the wafer W.

Figure 11:
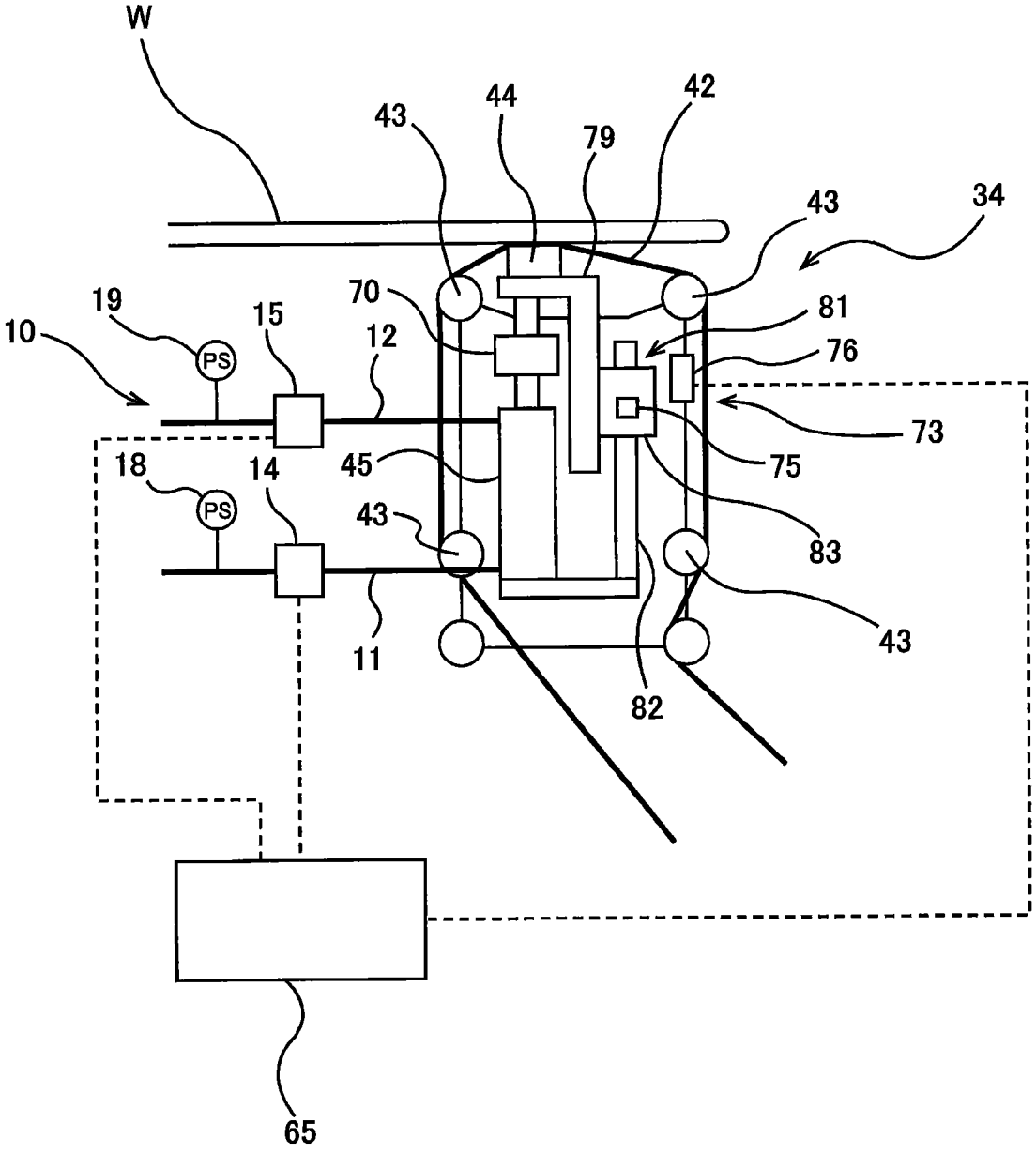
FIG. 11 is an enlarged view showing another embodiment of a polishing head.

FIG. 11 is an enlarged view of a polishing head 34 according to another embodiment. Structural details of the present embodiment that are not described in particular are identical to those of the embodiment shown in FIG. 10, and their repetitive descriptions will be omitted below. According to the present embodiment, the polishing head 34 includes a load cell 70 serving as a load measuring device disposed between the polishing tape 42 and the air cylinder (actuator) 45. More specifically, the load cell 70 is disposed between the pressing member 44 that supports the polishing tape 42 and the air cylinder 45. A load produced by the air cylinder 45 is transmitted via the load cell 70 to the pressing member 44. The load cell 70 is coupled to the monitoring device 65, and sends a measured value of the load therefrom to the monitoring device 65. The reasons why the load cell 70 is provided are the same as with the above embodiment.

The monitoring device 65 is configured to compare the load measured by the load cell 70 with a set value and to emit an alarm if the load is smaller than the set value. The set value is stored in advance in the monitoring device 65. The alarm may be an electric signal (e.g., an ON or OFF contact signal) for activating an external alarm device, an electric signal (e.g., an analog output such as a voltage) for transmitting information to an external device, or a recognizable signal such as a color, a sound, or the like. According to the present embodiment, the alarm based on the result of the comparison between the load and the set value is emitted, in addition to the alarm that is emitted based on the result of the comparison between the movement distance of the pressing member 44 and the threshold value as described above.

Figure 12:
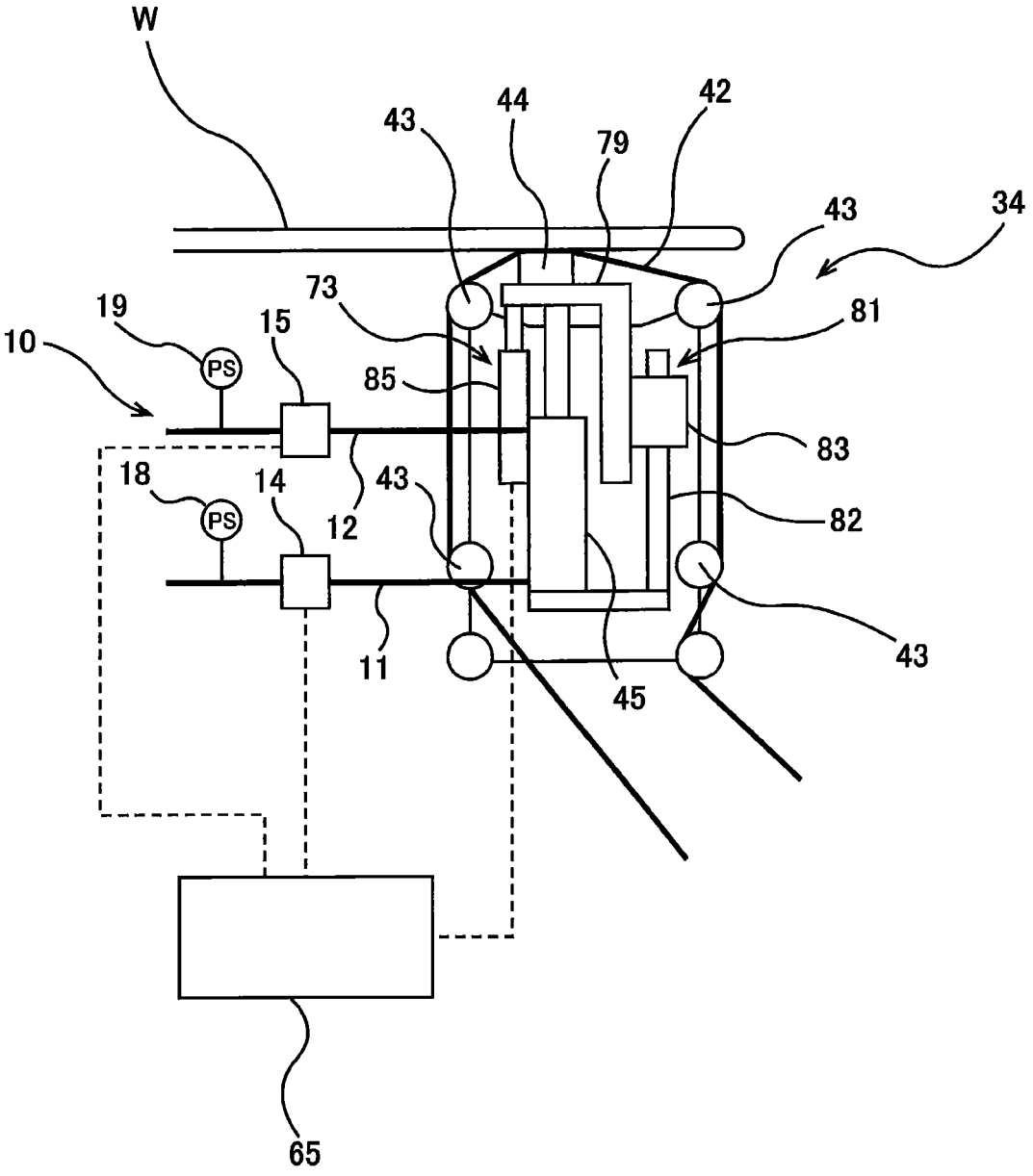
FIG. 12 is an enlarged view showing still another embodiment of a polishing head.

FIG. 12 is an enlarged view of a polishing head 34 according to still another embodiment. Structural details of the present embodiment that are not described in particular are identical to those of the embodiment shown in FIG. 10, and their repetitive descriptions will be omitted below. According to the present embodiment, the distance measuring device 73 includes a digital gage 85 which is a contact-type distance measuring device. The digital gage 85 is coupled to the pressing member 44 through a coupling base 79. Therefore, the digital gage 85 is able to measure the displacement of the pressing member 44, i.e., the movement distance of the pressing member 44 that has been moved toward the wafer W by the air cylinder 45. The digital gage 85 is coupled to the monitoring device 65. The digital gage 85 is configured to measure the movement distance of the pressing member 44 that has been moved toward the wafer W, and to send a measured value of the movement distance to the monitoring device 65.

In this embodiment also, the polishing head 34 may include, as shown in FIG. 11, the load cell 70 serving as a load measuring device disposed between the polishing tape 42 and the air cylinder (actuator) 45. As with the embodiment described above, if the movement distance of the pressing member 44, which is measured by the digital gage 85, is smaller than the above-described threshold value, then the monitoring device 65 may calculate a corrective pressing force from a preset target movement distance, the movement distance of the pressing member 44 which is measured by the proximity sensor 76, and a set value for the pressing force, and instruct the air cylinder 45 to generate the corrective pressing force.

Figure 13:
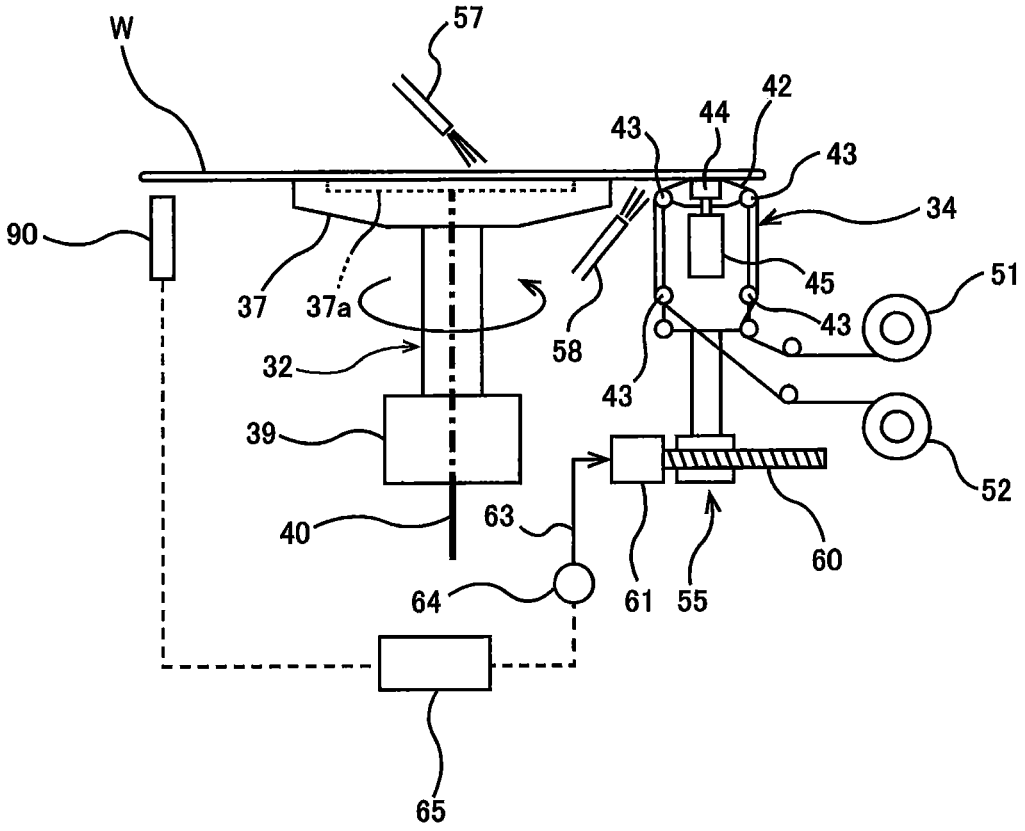
FIG. 13 is a view showing a polishing apparatus according to still another embodiment.

FIG. 13 is a view showing a polishing apparatus according to a still another embodiment. Structural and operational details that are not described in particular are identical to those of the embodiment shown in FIGS. 2 through 6, and their repetitive descriptions will be omitted below. According to the present embodiment, the polishing apparatus includes a surface-condition detector 90 for detecting a condition of a polished surface of the wafer W. The surface-condition detector 90 is configured to direct light to the polished surface of the wafer W, to receive reflected light from the polished surface, to analyze the reflected light, and to generate an incomplete polishing signal indicating that the polishing of the wafer W has not been completed yet, on the basis of the result of the analysis of the reflected light. The surface-condition detector 90 is coupled to the monitoring device 65, and sends the incomplete polishing signal to the monitoring device 65.

Figure 14A:
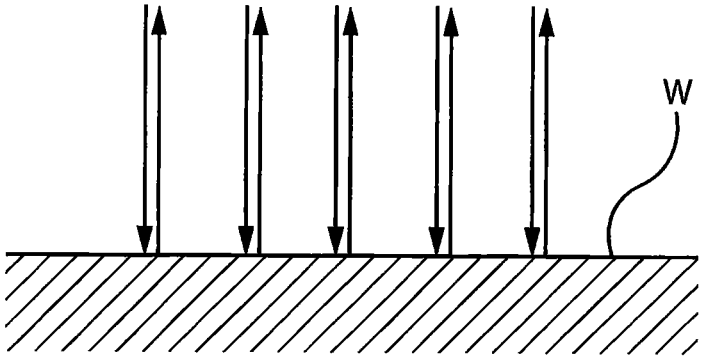
FIG. 14A and FIG. 14B are schematic views each showing light rays reflected off a surface of a wafer.
Figure 14B:
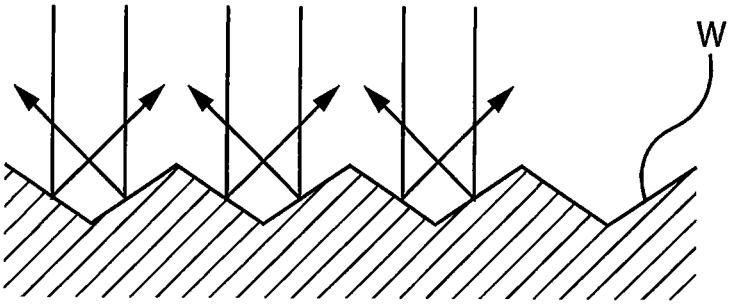

FIGS. 14A and 14B are schematic views each showing light rays reflected off a surface of a wafer W. As shown in FIG. 14A, if the wafer W has a mirror-finished surface as a result of the polishing thereof, then the light rays, reflected off the surface of the wafer W, do not interfere with each other. Conversely, as shown in FIG. 14B, if the wafer W has surface irregularities, then the light rays, reflected off the surface of the wafer W, interfere with each other, thus producing an interference pattern. According to the present embodiment, when the reflected light shows an interference pattern, the surface-condition detector 90 emits the incomplete polishing signal. When the polishing of the wafer W has progressed until the reflected light no longer shows an interference pattern, e.g., when the back surface of the wafer W is polished to a mirror finish, the surface-condition detector 90 stops emitting the incomplete polishing signal. The surface-condition detector 90 continuously or intermittently detects the condition of the polished surface of the wafer W, and keeps continuously or intermittently emitting the incomplete polishing signal as long as the reflected light shows an interference pattern.

As long as the monitoring device 65 continues to receive the incomplete polishing signal, the monitoring device 65 instructs the substrate holder 32, the polishing head 43, and the polishing-head moving device (motor-drive moving device) 55 to perform polishing of the wafer W again. Specifically, while the polishing head 34 is pressing the polishing tape 42 against the back surface of the wafer W, the polishing-head moving device 55 moves the polishing head 34 and the polishing tape 42 at a preset speed along the back surface of the wafer W outwardly in the radial direction of the wafer W. This polishing process is repeated as long as the monitoring device 65 keeps receiving the incomplete polishing signal. Polishing conditions including the pressing force produced by the air cylinder 45, the rotational speed of the wafer W, the speed at which the polishing head 34 and the polishing tape 42 are moved outwardly in the radial direction of the wafer W, etc. may be changed before the polishing process is repeated, or may remain the same while the polishing process is repeated. The monitoring device 65 terminates the polishing of the wafer W if the monitoring device 65 has not received the incomplete polishing signal during a certain set period of time.

The embodiment shown in FIG. 13 may be combined with the embodiments shown in FIGS. 8 through 12.

Figure 15:
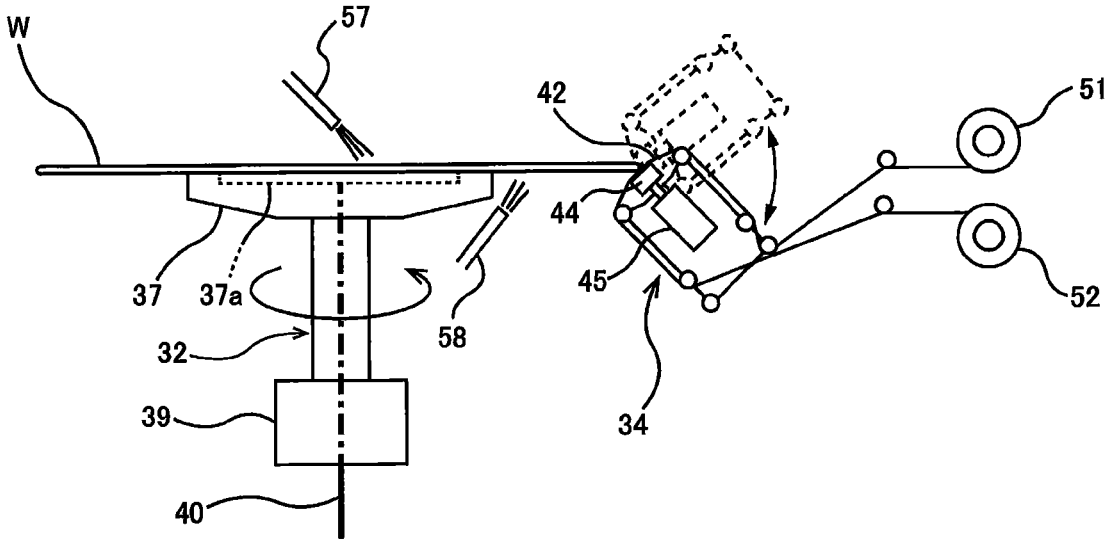
FIG. 15 is a schematic view of a polishing apparatus according to an embodiment wherein a polishing tape and a pressing member are moved along a bevel portion of a wafer.
Figure 16:
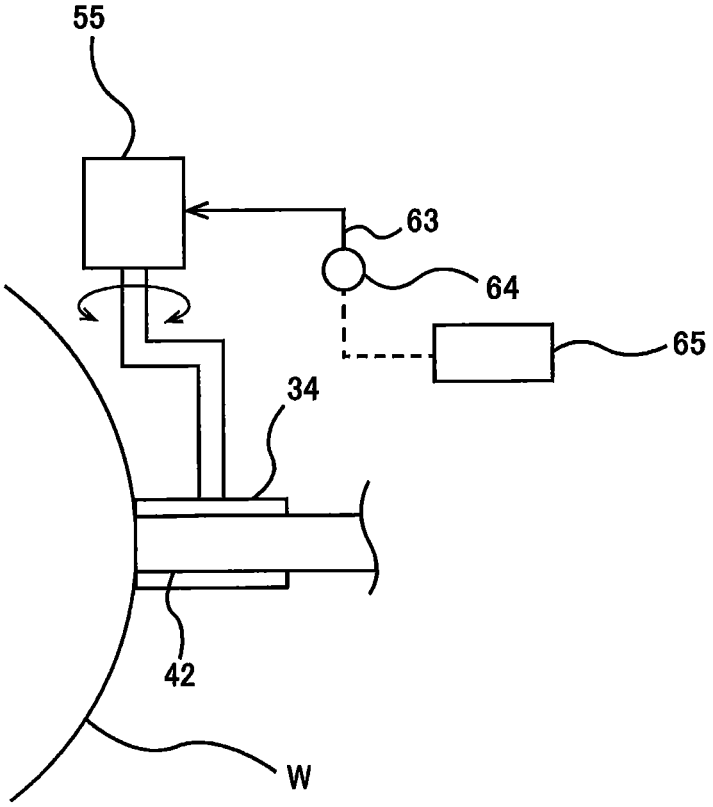
FIG. 16 is a plan view of the polishing apparatus shown in FIG. 15.

Each of the embodiments described above is directed to a polishing apparatus and a polishing method for polishing the back surface of a wafer. However, the present invention is also applicable to a polishing apparatus and a polishing method for polishing a front surface or a bevel portion of a wafer. For example, the present invention is applicable to a polishing apparatus that moves the polishing tape 42 and the pressing member 44 along the bevel portion of the wafer W, as shown in FIGS. 15 and 16.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a substrate holder configured to hold a wafer;

a polishing head including (i) a pressing member configured to press a polishing tool against a surface of the wafer; and (ii) an actuator configured to apply a pressing force to the pressing member;

a distance measuring device fixed to the polishing head, the distance measuring device being configured to measure a movement distance of the pressing member that has been moved toward the surface of the wafer by the actuator;

a motor-drive moving device configured to move the polishing head and the distance measurement device along the surface of the wafer; and a monitoring device configured to instruct the actuator to apply the pressing force to the pressing member to move the pressing member toward the surface of the wafer and to increase the pressing force when the movement distance is smaller than a preset threshold value.

2. The polishing apparatus according to claim 1, wherein the monitoring device is configured to instruct the motor-drive moving device to move the polishing head and the distance measurement device along the surface of the wafer, if the movement distance is larger than the preset threshold value.

3. The polishing apparatus according to claim 1, further comprising:

a load measuring device disposed between the pressing member and the actuator, wherein the monitoring device is configured to emit the alarm if a load measured by the load measuring device is smaller than a set value.

4. The polishing apparatus according to claim 1, wherein the distance measuring device comprises a non-contact-type distance sensor.

5. The polishing apparatus according to claim 1, wherein the distance measuring device comprises one of a digital gage, a magnetic sensor, and an eddy current sensor.

6. The polishing apparatus according to claim 1, wherein the monitoring device is configured to calculate a corrective pressing force from a preset target movement distance, the measured movement distance of the pressing member, and a set value for the pressing force, and instruct the actuator to generate the corrective pressing force.

7. The polishing apparatus according to claim 6, wherein the monitoring device stores a calculating formula therein which is expressed as corrective pressing force=(preset target movement distance/measured movement distance)×set value for the pressing force wherein the monitoring device is configured to input the preset target movement distance, the measured movement distance of the pressing member, and the set value for the pressing force into the calculating formula to determine the corrective pressing force.

8. The polishing apparatus according to claim 1, wherein:

the distance measuring device includes a proximity sensor and a sensor target;

the polishing head includes a coupling base and a linear-motion guide, the linear-motion guide being coupled to the pressing member through the coupling base;

the linear-motion guide includes a linear-motion rail and a linear-motion block, the linear-motion block being movable on the linear-motion rail in the longitudinal direction of the linear-motion rail;

the linear-motion block is coupled to the pressing member through the coupling base; and the sensor target is fixed to the linear-motion block.

9. The polishing apparatus according to claim 8, wherein the proximity sensor is located near the sensor target, and a relative position of the proximity sensor and the polishing head is fixed.

10. The polishing apparatus according to claim 8, wherein the sensor target comprises a permanent magnet or a metal.

11. A polishing method comprising:

holding a wafer with a substrate holder;

moving a pressing member, which supports a polishing tool, toward a surface of the wafer, to be polished, by applying a pressing force to the pressing member with an actuator;

measuring a movement distance of the pressing member that has been moved by the actuator; and increasing the pressing force applied from the actuator to the pressing member when the measured movement distance is smaller than a preset threshold value.

12. The polishing method according to claim 11, further comprising:

moving the pressing member along the surface of the wafer with a motor-drive moving device if the movement distance is larger than the preset threshold value.

13. The polishing method according to claim 11, further comprising:

measuring a load applied from the actuator to the pressing member; and emitting an alarm if the load is smaller than a set value.

14. The polishing method according to claim 11, wherein the surface of the wafer comprises a back surface of the wafer.

15. The polishing method according to claim 11, wherein increasing the pressing force comprises calculating a corrective pressing force from a preset target movement distance, the measured movement distance of the pressing member, and a set value for the pressing force when the measured movement distance is smaller than the preset threshold value, and instructing the actuator to generate the corrective pressing force.

16. The polishing method according to claim 15, wherein calculating the corrective pressing force comprises inputting the preset target movement distance, the measured movement distance of the pressing member, and the set value for the pressing force into a calculating formula to determine the corrective pressing force, the calculating formula being expressed as corrective pressing force=(preset target movement distance/measured movement distance)×set value for the pressing force.

* * * * *